US009587451B2

(12) United States Patent
Ringgenberg et al.

(10) Patent No.: US 9,587,451 B2
(45) **Date of Patent: *Mar. 7, 2017**

(54) DEACTIVATION OF PACKER WITH SAFETY JOINT

(71) Applicant: HALLIBURTON ENERGY SERVICES, INC., Houston, TX (US)

(72) Inventors: Paul D. Ringgenberg, Frisco, TX (US); Scott L. Miller, Highland Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/306,668

(22) Filed: Jun. 17, 2014

(65) Prior Publication Data

US 2014/0290965 A1 Oct. 2, 2014

Related U.S. Application Data

(63) Continuation of application No. 13/772,023, filed on Feb. 20, 2013, now Pat. No. 8,783,370.

(30) Foreign Application Priority Data

Mar. 6, 2012 (WO) ..... PCT/US2012/027799

(51) Int. Cl.
*E21B 23/00* (2006.01)
*E21B 17/06* (2006.01)
(Continued)

(52) U.S. Cl.
CPC ..... *E21B 23/00* (2013.01); *E21B 17/06* (2013.01); *E21B 33/12* (2013.01); *E21B 33/1291* (2013.01)

(58) Field of Classification Search
CPC ..... E21B 17/06; E21B 23/00; E21B 33/1293; E21B 23/06; E21B 33/1291; E21B 33/1292; E21B 33/12; E21B 33/122; E21B 33/128
See application file for complete search history.

(56) References Cited

U.S. PATENT DOCUMENTS 2,026,931 A 1/1936 Burns et al.
2,202,260 A 5/1940 Osmun
(Continued)

FOREIGN PATENT DOCUMENTS

EP 0928361 B1 2/2004
WO 2010061231 A1 6/2010

OTHER PUBLICATIONS

International Search Report with Written Opinion issued Aug. 3, 2012 for PCT Patent Application No. PCT/US11/064762, 9 pages.
(Continued)

*Primary Examiner* — Kenneth L Thompson
*Assistant Examiner* — Wei Wang
(74) *Attorney, Agent, or Firm* — Chamberlain Hrdlicka

(57) ABSTRACT

A packer deactivation system can include a packer and a safety joint. Activation of the safety joint can prevent setting of the packer. A method for use with a subterranean well can include activating a safety joint in the well, and deactivating a packer connected to the safety joint, in response to the safety joint activating. Another packer deactivation system can include a safety joint and a packer drag block locking mechanism. Activation of the safety joint can operate the drag block locking mechanism, thereby preventing a drag block from displacing in a certain direction relative to a mandrel of a packer.

10 Claims, 6 Drawing Sheets

(51) Int. Cl.
*E21B 33/12* (2006.01)
*E21B 33/129* (2006.01)

(56) References Cited

U.S. PATENT DOCUMENTS

| | | | | |
|---|---|---|---|---|
| 2,409,811 | A | | 10/1946 | Taylor et al. |
| 2,626,781 | A | | 1/1953 | Reynolds |
| 2,802,534 | A | | 8/1957 | Conrad |
| 2,819,877 | A | | 1/1958 | Koppl |
| 2,919,900 | A | | 1/1960 | Segelhorst |
| 2,952,482 | A | | 9/1960 | Torres |
| 3,043,372 | A | | 7/1962 | Davis |
| 3,050,131 | A | | 8/1962 | Siracusa et al. |
| 3,461,982 | A | | 8/1969 | Reardon |
| 3,524,501 | A | | 8/1970 | Armstrong |
| 3,559,732 | A | | 2/1971 | Tucker |
| 3,966,236 | A | | 6/1976 | Vann |
| 4,018,274 | A | * | 4/1977 | Cochran ..... 166/129 |
| 4,066,282 | A | | 1/1978 | Vann |
| 4,175,778 | A | | 11/1979 | Nunez et al. |
| 4,452,472 | A | | 6/1984 | Crase |
| 4,484,633 | A | | 11/1984 | Brandell |
| 4,716,960 | A | | 1/1988 | Eastlund et al. |
| 4,858,690 | A | | 8/1989 | Rebardi et al. |
| 4,971,365 | A | | 11/1990 | Schultz |
| 4,989,672 | A | | 2/1991 | Burns, Sr. et al. |
| 5,178,219 | A | * | 1/1993 | Striech ..... E21B 33/124 166/127 |
| 5,224,547 | A | | 7/1993 | Burns, Sr. et al. |
| 5,242,201 | A | | 9/1993 | Beeman |
| 5,323,855 | A | | 6/1994 | Evans |
| 5,526,888 | A | | 6/1996 | Gazewood |
| 5,695,009 | A | | 12/1997 | Hipp |
| 5,718,291 | A | | 2/1998 | Lorgen et al. |
| 5,810,088 | A | | 9/1998 | Lamirand et al. |
| 5,984,029 | A | | 11/1999 | Griffin et al. |
| 6,112,808 | A | | 9/2000 | Isted |
| 6,131,953 | A | | 10/2000 | Connell et al. |
| 6,318,470 | B1 | | 11/2001 | Chang et al. |
| 6,408,946 | B1 | | 6/2002 | Marshall et al. |
| 6,588,500 | B2 | | 7/2003 | Lewis |
| 6,712,146 | B2 | | 3/2004 | Estep et al. |
| 7,100,696 | B2 | | 9/2006 | Marshall |
| 7,152,674 | B2 | | 12/2006 | Bowles |
| 7,204,305 | B2 | | 4/2007 | Ricalton et al. |
| 7,373,974 | B2 | | 5/2008 | Connell et al. |
| 7,380,596 | B2 | | 6/2008 | De Clute-Melancon |
| 7,431,094 | B2 | | 10/2008 | De Clute-Melancon |
| 7,597,148 | B2 | | 10/2009 | O'Malley et al. |
| 7,681,642 | B2 | | 3/2010 | Bell et al. |
| 8,141,634 | B2 | | 3/2012 | Fisher et al. |
| 8,316,954 | B2 | | 11/2012 | McGlothen |
| 8,727,019 | B2 | | 5/2014 | Ringgenberg |
| 8,733,451 | B2 | | 5/2014 | Zevenbergen et al. |
| 8,783,370 | B2 | | 7/2014 | Ringgenberg et al. |
| 2005/0029017 | A1 | | 2/2005 | Berkheimer et al. |
| 2005/0283276 | A1 | | 12/2005 | Prescott et al. |
| 2005/0284659 | A1 | | 12/2005 | Hall et al. |
| 2006/0048941 | A1 | | 3/2006 | Borst et al. |
| 2006/0131011 | A1 | | 6/2006 | Lynde et al. |
| 2007/0034372 | A1 | | 2/2007 | Moyes |
| 2008/0099210 | A1 | | 5/2008 | Gazewood |
| 2008/0236810 | A1 | | 10/2008 | Bornes et al. |
| 2009/0025931 | A1 | | 1/2009 | Soni et al. |
| 2009/0095490 | A1 | | 4/2009 | Moriarty et al. |
| 2009/0111715 | A1 | | 4/2009 | Ballard et al. |
| 2011/0308784 | A1 | | 12/2011 | Ollerenshaw et al. |
| 2012/0068712 | A1 | | 3/2012 | Taherian et al. |
| 2013/0153230 | A1 | | 6/2013 | Scott et al. |
| 2013/0233566 | A1 | | 9/2013 | Ringgenberg |
| 2013/0233567 | A1 | | 9/2013 | Zevenbergen et al. |
| 2013/0233573 | A1 | | 9/2013 | Ringgenberg et al. |

OTHER PUBLICATIONS

Office Action issued Sep. 5, 2013 for U.S. Appl. No. 13/678,158, 17 pages.
Office Action issued Mar. 14, 2014 for U.S. Appl. No. 13/678,158, 12 pages.
Office Action issued Jul. 11, 2014 for U.S. Appl. No. 13/678,158, 17 pages.
Halliburton; "Body Lock Ring", Mechanical Downhole: Technology Transfer, dated Oct. 10, 2001, 4 pages.
International Search Report with Written Opinion issued Nov. 5, 2012 for PCT Patent Application No. PCT/US12/027799, 9 pages.
International Search Report with Written Opinion issued Nov. 14, 2012 for PCT Patent Application No. PCT/US12/027797, 9 pages.
International Search Report with Written Opinion issued Nov. 29, 2012 for PCT Patent Application No. PCT/US12/027803, 9 pages.
Halliburton; "Cased Hole", company article pp. 5-7 to 5-38, retrieved Dec. 20, 2011, 32 pages.
Halliburton; "RTTS Safety Joint", Company article H08346, dated Apr. 2011, 2 pages.
Halliburton; "Champ IV Non-Rotational Retrievable Packer", Completion Tools article, retrieved Dec. 17, 2011, 1 page.
Halliburton; "Below Packer Hydraulic Safety Joint", company article, retrieved Dec. 17, 2011, 1 page.
Halliburton; "Anchor Pipe Safety Joint", company article, retrieved Oct. 27, 2011, 10 pages.
Office Action issued Sep. 26, 2013 for U.S. Appl. No. 13/975,241, 13 pages.
Office Action issued Jun. 11, 2013 for U.S. Appl. No. 13/771,990, 21 pages.
Schlumberger, online search for glossary term, "Jar," at http://www.glossary.oilfield.slb.com/en/Terms.aspx?LookIn=term name &filter=JAR&p=1, accessed Jun. 20, 2013.
Office Action issued Jul. 24, 2013 for U.S. Appl. No. 13/772,023, 25 pages.
Office Action issued Nov. 18, 2013 for U.S. Appl. No. 13/772,023, 17 pages.
Halliburton; "Champ V Non-Rotational Retrievable Packer", Test Tools article, retrieved Oct. 27, 2011, 2 pages.
Halliburton; "VR Safety Joint", Test Tools article, retrieved Oct. 27, 2011, 1 page.

* cited by examiner

DEACTIVATION OF PACKER WITH SAFETY JOINT

CROSS-REFERENCE TO RELATED APPLICATION APPLICATIONS

This application is a continuation of U.S. application Ser. No. 13/772,023 filed on 20 Feb. 2013, which claims the benefit under 35 USC §119 of the filing date of International Application Serial No. PCT/US12/27799 filed 6 Mar. 2012. The entire disclosures of these prior applications are incorporated herein by this reference.

BACKGROUND

This disclosure relates generally to equipment utilized and operations performed in conjunction with a subterranean well and, in one example described below, more particularly provides for deactivation of a packer with a safety joint.

A safety joint is typically positioned above or below a packer to allow a tubular string to be disconnected at the safety joint in the event that the packer or other equipment below the packer becomes stuck in a wellbore. After the safety joint is activated, the tubular string above the safety joint can be readily retrieved from the wellbore.

It will be appreciated that improvements are continually needed in the art of constructing packers and safety joints.

SUMMARY

In this disclosure, systems and methods are provided which bring improvements to the arts of constructing and operating packers and safety joints. One example is described below in which activation of the safety joint deactivates (prevents setting of) the packer. Another example is described below in which a drag block on the packer is secured against displacement in at least one direction relative to a mandrel of the packer, in response to activation of the safety joint.

A packer deactivation system is described below. In one example, the system can include a packer and a safety joint. Activation of the safety joint prevents setting of the packer.

A method for use with a subterranean well is also described below. One example of the method can include activating a safety joint in the well; and deactivating a packer connected to the safety joint, in response to the safety joint activating.

Another packer deactivation system described below can include a safety joint and a packer drag block locking mechanism. Activation of the safety joint operates the drag block locking mechanism, thereby preventing a drag block from displacing in a certain direction relative to a mandrel of a packer.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
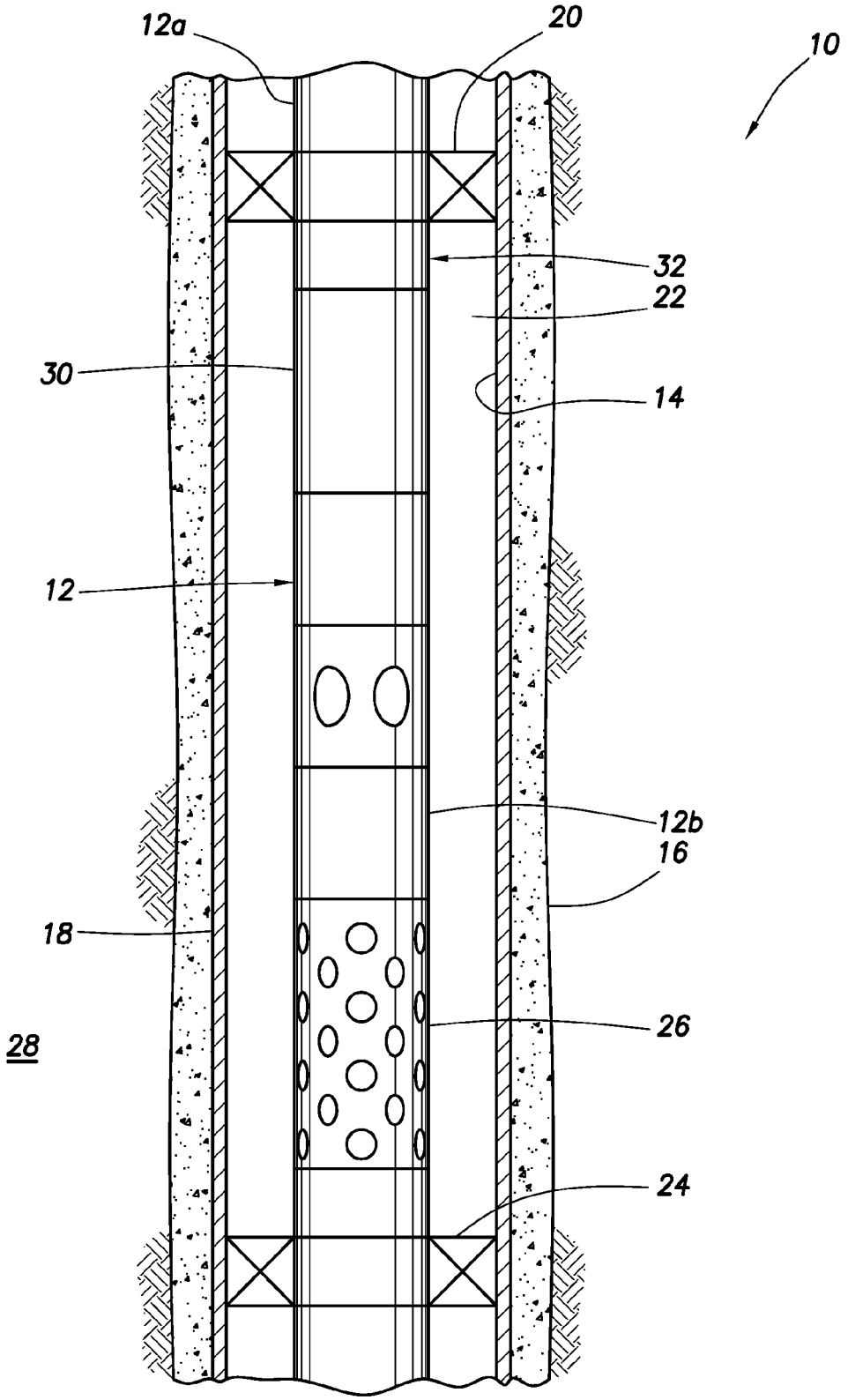
FIG. 1 is a representative partially cross-sectional view of a well system and associated method which can embody principles of this disclosure.

Representatively illustrated in FIG. 1 is a well system 10 and associated method which can embody principles of this disclosure. However, it should be clearly understood that the system 10 and method are merely one example of how the principles of this disclosure can be applied in practice, and so the scope of this disclosure is not limited at all to the details of the system and method as depicted in the drawings and described below.

In the FIG. 1 example, a tubular string 12 is installed in a wellbore 14 lined with cement 16 and casing 18. A packer 20 is set to thereby seal off an annulus 22 formed radially between the tubular string 12 and the wellbore 14. Another packer 24 (or a bridge plug, etc.) may be used if desired to seal off the wellbore 14, so that the annulus 22 is isolated between the packers 20, 24.

The tubular string 12 could be used for any purpose (such as, drill stem testing, completion operations, stimulation operations, etc.). In the depicted example, one or more perforating guns 26 are interconnected in the tubular string 12 for perforating the casing 18 and cement 16, so that fluid can be produced from, or injected into, an earth formation 28 penetrated by the wellbore 14. The formation 28 can then be tested by performing pressure buildup and drawdown tests, in a manner well known to those skilled in the art.

A safety joint 30 is interconnected in the tubular string 12 below the packer 20 (as viewed in FIG. 1). In the event that the packer 24, the perforating gun 26 or another item of equipment below the safety joint 30 becomes stuck or otherwise cannot be readily retrieved from the wellbore 14, the safety joint can be activated to disconnect an upper section 12*a* of the tubular string 12 from a lower section 12*b* of the tubular string, so that the upper section can be retrieved. A separate "fishing" trip can then be used to retrieve the lower section 12*b* of the tubular string 12.

Note that it is not necessary for all of the wellbore 14 to be lined with cement 16 or casing 18, the tubular string 12 could include additional, fewer or different components from those depicted in FIG. 1, the wellbore can be horizontal or inclined, etc. Thus, it will be appreciated that the scope of this disclosure is not limited to the example representatively illustrated in FIG. 1.

Unfortunately, in certain circumstances (such as, when operating from a floating rig, etc.), it can be possible to again set a packer after a safety joint has been activated, but prior to disconnection of the tubular string sections 12*a,b* from each other. This due to the fact that many, if not most, retrievable packers are set by lowering a tubular string in which the packer is connected (typically after performing some other action, such as, rotating the tubular string to operate a J-slot mechanism, lowering and raising the tubular string a predetermined number of times, applying a predetermined pressure to the packer, etc.), and lowering of the tubular string can occur inadvertently (e.g., due to wave motion heave on a floating rig, setting surface slips when disconnecting pipe joints, etc.).

If this happens (re-setting of the packer after activation of the safety joint but prior to disconnection of the tubular string sections), it can be very difficult, time-consuming and, therefore, very expensive to use contingency measures (e.g., washing-over the packer, using chemical or explosive means to sever a mandrel of the packer, etc.) to retrieve the packer. One reason for this is that to unset many, if not most, retrievable packers, the packer mandrel is raised a predetermined distance, and this typically cannot be done if the safety joint has already been activated but the tubular string has not yet disconnected at the safety joint.

However, in the improved system 10 and method of FIG. 1, a packer deactivation system 32 prevents the packer 20 from setting after the safety joint 30 has been activated. In this manner, the upper section 12*a* of the tubular string 12 can be conveniently retrieved from the wellbore 14, without the possibility of the packer 20 inadvertently setting after the safety joint 30 has been activated. In an example described more fully below, the packer 20 can be deactivated, whether or not the tubular string 12 has been disconnected at the safety joint 30.

Figure 2:
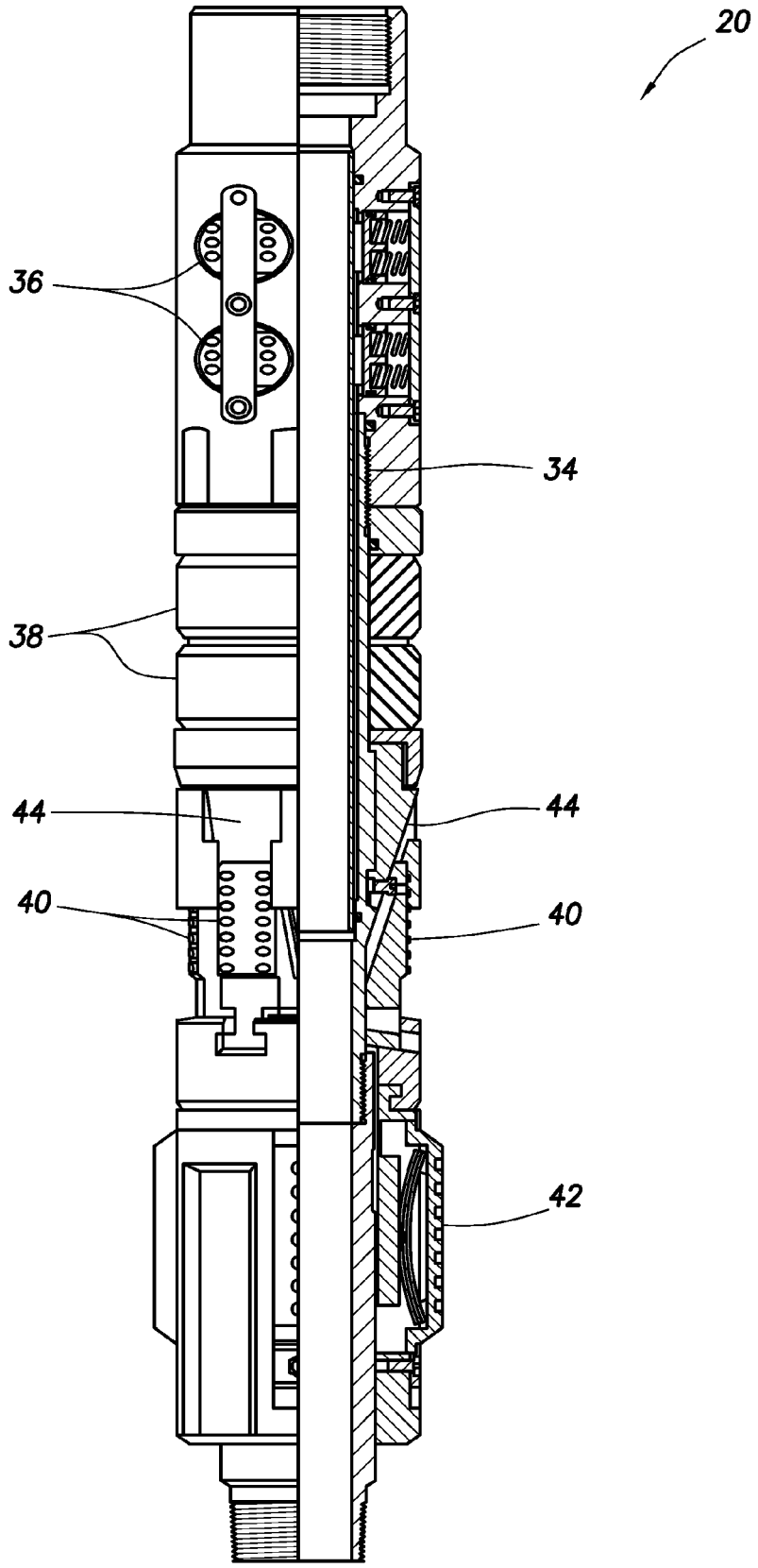
FIG. 2 is a partially cross-sectional view of a prior art packer.

Referring additionally now to FIG. 2, the packer 20 is representatively illustrated, apart from the remainder of the system 10. The packer 20 may be similar in many respects to a prior art RTTS™ packer marketed by Halliburton Energy Services, Inc. of Houston, Tex. USA, and well known to those skilled in the art.

However, other types of packers may be used in the system 10, in keeping with the scope of this disclosure. Examples of other packers which may be used include the CHAMP IV™ and CHAMP V™ packers, also marketed by Halliburton Energy Services, Inc.

The packer 20 is representative of a retrievable packer, operation of which can benefit from the principles of this disclosure. The packer deactivation system 32 can be used to prevent setting of the packer 20 when the safety joint 30 is activated.

The packer 20 includes a generally tubular mandrel 34, a set of hydraulically actuated slips 36, a set of seal elements 38, a set of mechanically actuated slips 40 and a drag block 42. A J-slot mechanism (not visible in FIG. 2) controls whether the mandrel 34 can be lowered (as viewed in FIG. 2) relative to the seal elements 38, slips 40 and drag block 42. The drag block 42 is biased into contact with an inner wall of the casing 18 (or the formation 28 in an uncased wellbore) and thereby provides a frictional force, so that the mandrel 34 will displace downward relative to the seal elements 38, slips 40 and drag block when the J-slot mechanism is operated to its "set" position.

To set the packer 20, the packer is positioned lower in the wellbore 14 than its intended setting location, the packer is then raised and rotated to select the J-slot mechanism "set" position, and the tubular string 12 is then lowered to set the packer. The frictional force provided by the drag block 42 urges the slips 40 upward along ramps 44, so that the slips displace radially outward and obtain an initial "bite" into the casing 18 (or formation 28 if the wellbore 14 is uncased). Further lowering of the tubular string 12 and mandrel 34 compresses the seal elements 38, thereby radially outwardly extending the seal elements and sealing off the annulus 22.

Note that, if the drag block 42 cannot displace upward relative to the mandrel 34, the slips 40 will not displace radially outward, and the packer 20 will not set in response to downward displacement of the mandrel (and the tubular string 12 to which it is connected). Therefore, by preventing upward displacement of the drag block 42, setting of the packer 20 can also be prevented.

After being set, the packer 20 can be unset by raising the mandrel 34, thereby decompressing the seal elements 38 and allowing the slips 40 to retract inward.

Figure 3:
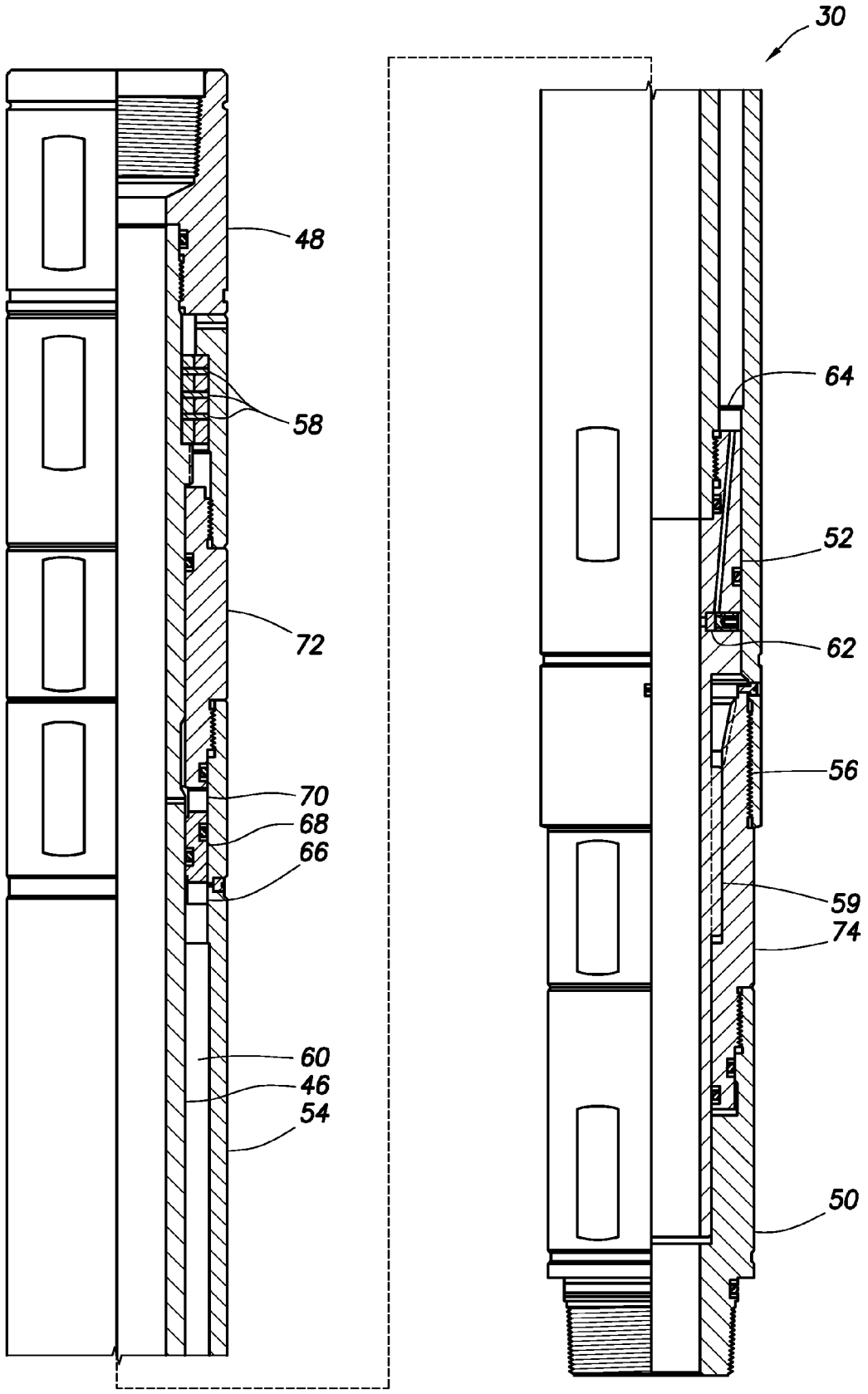
FIG. 3 is a partially cross-sectional view of a prior art safety joint.

Referring additionally now to FIG. 3, the safety joint 30 is representatively illustrated, apart from the remainder of the system 10. The safety joint 30 may be similar in many respects to a prior art Below Packer Hydraulic Safety Joint marketed by Halliburton Energy Services, Inc., and well known to those skilled in the art.

However, other types of safety joints may be used in the system 10, in keeping with the scope of this disclosure. Examples of other safety joints which may be used include the Anchor Pipe Safety Joint, the RTTS Safety Joint and the VR Safety Joint, also marketed by Halliburton Energy Services, Inc.

The safety joint 30 is representative of a typical safety joint, operation of which can benefit from the principles of this disclosure. The packer deactivation system 32 can be used to prevent setting of the packer 20 when the safety joint 30 is activated.

The safety joint 30 includes a generally tubular mandrel 46 extending between end connectors 48, 50. When interconnected in the tubular string 12, the upper section 12*a* is connected to the connector 48, and the lower section 12*b* is connected to the connector 50.

A piston 52 is connected at a lower end of the mandrel 46. The piston 52 is sealingly and reciprocably received in an outer housing 54.

The lower connector 50 is connected to the outer housing 54 via left-hand threads 56. The mandrel 46 is connected to the upper connector 48.

Relative rotation between the mandrel 46 and the outer housing 54 is initially prevented by axially extending splines 59. Thus, right-hand torque can initially be transmitted from the upper connector 48 to the lower connector 50 via the mandrel 46 and splines 59.

Relative axial displacement between the mandrel 46 and the outer housing 54 is initially prevented by shear pins 58. However, if the lower connector 50 is secured against displacement in the wellbore 14 (e.g., if the lower tubular string section 12*b* has become stuck, etc.), and a predetermined upwardly directed axial force is applied to the upper connector 48, the shear pins 58 will shear, thereby permitting relative axial displacement between the mandrel 46 and the outer housing 54. The splines 59 do not prevent such relative axial displacement between the mandrel 46 and the outer housing 54.

A hydraulic fluid is contained in an annular chamber 60 formed radially between the mandrel 46 and the outer housing 54. When the mandrel 46 is permitted to displace axially upward relative to the outer housing 54, the piston 52 will compress the fluid in the chamber 60. When pressure in the chamber 60 reaches a predetermined level, a rupture disk 62 will burst, allowing the fluid to drain from the chamber, and thereby permitting relatively unrestricted upward displacement of the mandrel 46 relative to the outer housing 54.

In this example, about a meter of upward displacement of the mandrel 46 is permitted relative to the outer housing 54. This upward displacement should be sufficient to accomplish unsetting of the packer 20, with the safety joint mandrel 46 being connected to the packer mandrel 34 and the remainder of the tubular string upper section 12*a*.

When displaced fully upward, castellated lugs 64 on an upper end of the piston 52 engage complementary lugs 66 on a floating piston 68, which also has lugs 70 which engage similar lugs (not visible in FIG. 3) on a component 72 connected to the outer housing 54. This engagement of lugs 64, 66, 70 (as well as those on the component 72) prevents relative rotation between the mandrel 46 and the outer housing 54. At this point, the splines 59 are disengaged.

Right-hand rotation can then be applied from the tubular string upper section 12*a* to the upper connector 48, mandrel 46 and outer housing 54 to "unscrew" the threads 56. The tubular string upper section 12*a*, along with the upper connector 48, mandrel 46, outer housing 54, component 72, pistons 52, 68, etc., can then be retrieved from the wellbore 14.

The lower connector 50 and an upwardly facing internally threaded component 74 are left attached to the tubular string lower section 12*b*. The internally threaded component 74 provides for convenient "fishing" of the tubular string lower section 12*b*.

In examples described more fully below, the packer deactivation system 32 prevents re-setting of the packer 20 when the shear pins 58 are sheared and the safety joint mandrel 46 is displaced upward relative to the outer housing 54 to unset the packer. Thus, the activation of the safety joint 30 also causes deactivation of the packer 20.

In other examples, the safety joint 30 could be activated in other ways, the packer 20 could be deactivated at another point in the activation of the safety joint, etc. Therefore, it should be clearly understood that the scope of this disclosure is not limited at all to the specific details of the safety joint 30 activation and the packer 20 deactivation described herein and depicted in the drawings.

Figure 4:
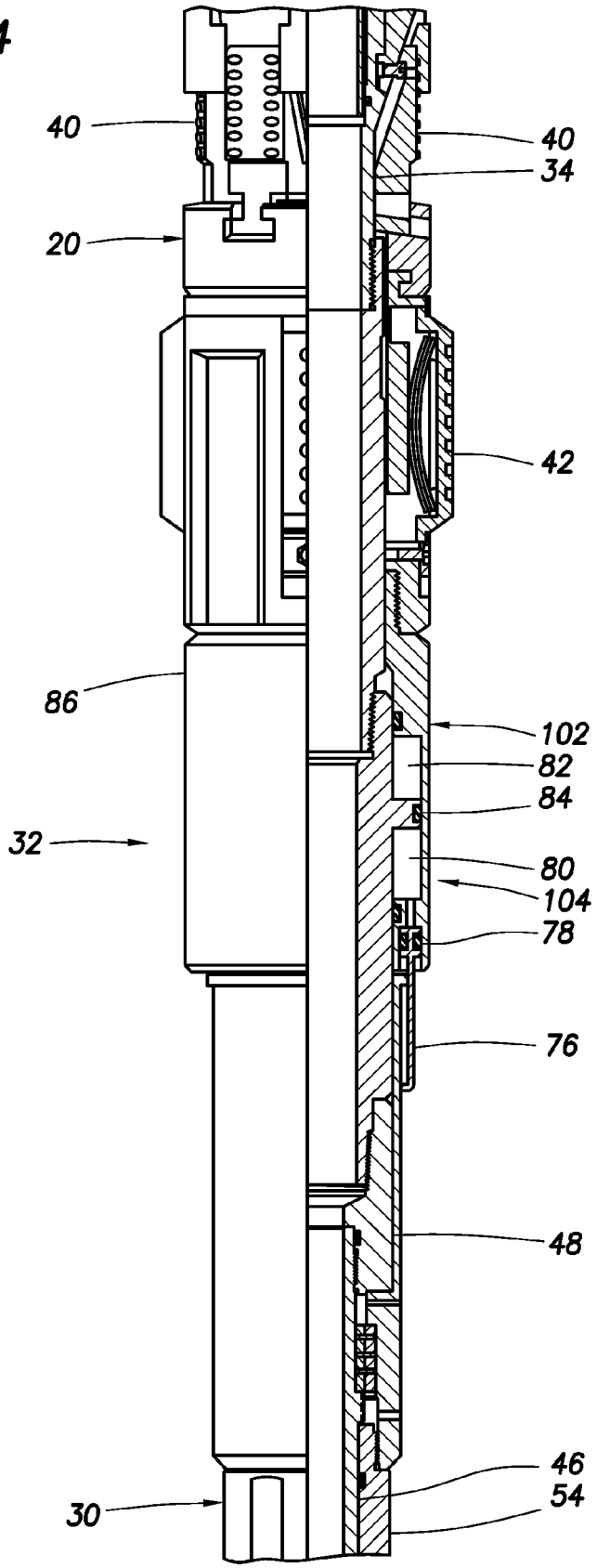
FIG. 4 is a representative partially cross-sectional view of a packer deactivation system which can embody principles of this disclosure, and which can be used in the well system of FIG. 1.

Referring additionally now to FIG. 4, an example of the packer deactivation system 32 is representatively illustrated. The system 32 includes a packer deactivation device 102 interconnected between the packer 20 and the safety joint 30. However, the packer deactivation system 32 could be used with other packers and safety joints, in keeping with the scope of this disclosure.

In the FIG. 4 example, a telescoping joint 76 is connected at its lower end to the outer housing 54. At its upper end, the telescoping joint 76 has a plug 78 which prevents well pressure from entering a chamber 80. The chamber 80 is separated from another chamber 82 by a piston 84.

Initially, both of the chambers 80, 84 preferably are equally pressurized with a gas (such as air at atmospheric pressure, Nitrogen at a relatively low pressure, etc.). In this manner, the drag block 42 to which an outer housing 86 of the system 32 is attached can displace relative to the packer mandrel 34, so that the packer 20 can be set and unset as desired.

However, when the safety joint mandrel 46 is displaced upwardly relative to the safety joint outer housing 54 (after the shear pins 58 are sheared) to activate the safety joint 30, the telescoping joint 76 will eventually reach an end of its travel, and the plug 78 will be thereby pulled out of the housing 86, exposing the chamber 80 to well pressure. When the chamber 80 is exposed to well pressure, a resulting pressure differential across the piston 84 will cause the housing 86 (and drag block 42 to which the housing 86 is attached) to be biased downward relative to the piston 84 (and mandrel 34 to which the piston is attached).

This will prevent upward displacement of the drag block 42 relative to the packer mandrel 34, thereby preventing the packer 20 from setting. The tubular string upper section 12*a* can then be disconnected from the lower section 12*b* by right-hand rotation of the upper section to unscrew the threads 56, as described above. The upper section 12*a* can be retrieved from the wellbore 14 without concern that the packer 20 will set again.

Figure 5:
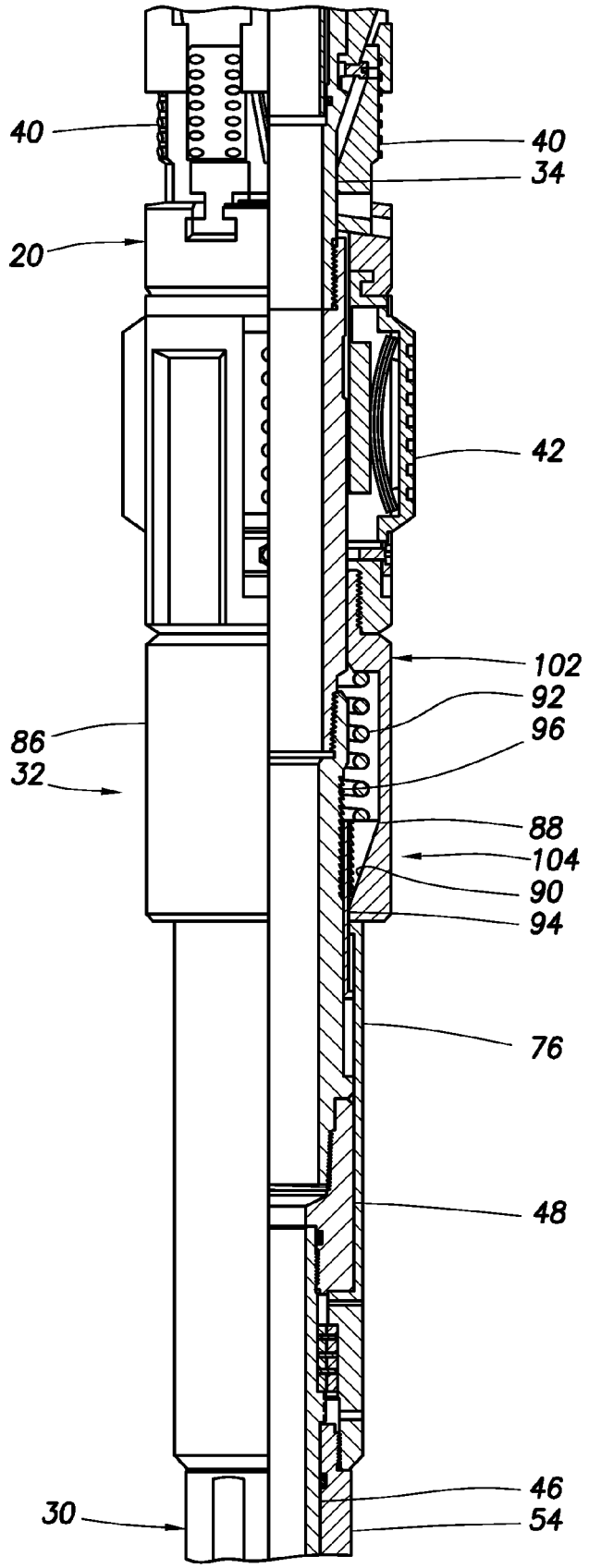
FIG. 5 is a representative partially cross-sectional view of another configuration of the packer deactivation system.

Referring additionally now to FIG. 5, another configuration of the packer deactivation system 32 is representatively illustrated. In this example, the outer housing 86 of the packer deactivation system 32 encloses segmented slips or other gripping devices 88 biased against a conical ramp 90 by a biasing device 92 (such as, a spring, pressurized gas chamber, etc.).

The gripping devices 88 are biased radially inward by the ramp 90, but an upper sleeve end 94 of the telescoping joint 76 prevents the slips from contacting a serrated outer surface of a mandrel 96 in the housing 86. The mandrel 96 is connected between the packer mandrel 34 and the upper connector 48 of the safety joint 30.

Because the gripping devices 88 are initially retained by the sleeve end 94 out of contact with the mandrel 96, the housing 86 and drag block 42 can displace relative to the mandrels 34, 96 as desired to set and unset the packer 20. However, if the gripping devices 88 are permitted to displace radially inward to contact the mandrel 96, upward displacement of the drag block 42 relative to the mandrel 34 will be prevented, thereby preventing the packer 20 from setting.

When the safety joint mandrel 46 is displaced upwardly relative to the safety joint outer housing 54 (after the shear pins 58 are sheared) to activate the safety joint 30, the telescoping joint 76 will eventually reach the end of its travel, and the sleeve end 94 will be thereby pulled out from under the gripping devices 88. The gripping devices 88 will displace radially inward into contact with the mandrel 96, due to the action of the biasing device 92 and ramp 90 on the gripping devices.

This will prevent upward displacement of the drag block 42 relative to the packer mandrel 34, thereby preventing the packer 20 from setting. The tubular string upper section 12*a* can then be disconnected from the lower section 12*b* by right-hand rotation of the upper section to unscrew the threads 56, as described above. The upper section 12*a* can be retrieved from the wellbore 14 without concern that the packer 20 will set again.

Figure 6:
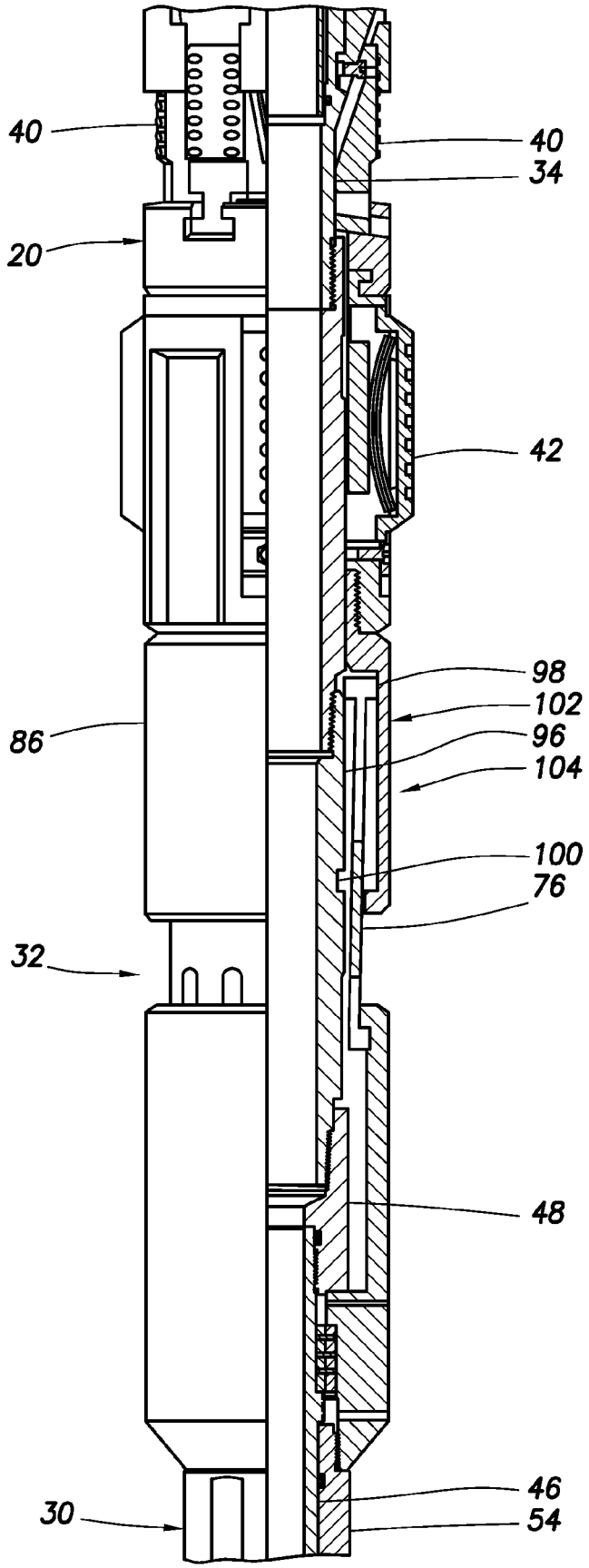
FIG. 6 is a representative partially cross-sectional view of yet another configuration of the packer deactivation system.

Referring additionally now to FIG. 6, another configuration of the packer deactivation system 32 is representatively illustrated. In this example, the housing 86 is part of the telescoping joint 76.

Resilient collets 98 are positioned in the housing 86. The collets 98 are dimensioned for cooperative engagement with a recess 100 formed on the mandrel 96. Until the collets 98 are engaged with the recess 100, the housing 86 (and drag block 42 to which the housing is attached) can displace upwardly relative to the mandrel 96 (and packer mandrel 34 to which the mandrel 96 is attached). Thus, the packer 20 can be set and unset as desired.

However, when the safety joint mandrel 46 is displaced upwardly relative to the safety joint outer housing 54 (after the shear pins 58 are sheared) to activate the safety joint 30, the telescoping joint 76 will eventually reach an end of its travel, and the collets 98 will engage the recess 100. When the collets 98 engage the recess 110, upward displacement of the housing 86 relative to the mandrel 96 will be prevented.

This will prevent upward displacement of the drag block 42 relative to the packer mandrel 34, thereby preventing the packer 20 from setting. The tubular string upper section 12*a* can then be disconnected from the lower section 12*b* by right-hand rotation of the upper section to unscrew the threads 56, as described above. The upper section 12*a* can be retrieved from the wellbore 14 without concern that the packer 20 will set again.

Although, in the packer deactivation system 32 examples described above, a packer deactivation device 102 (including the housing 86, mandrel 96, etc.) is separate from (but connected to) the packer 20 and safety joint 30, it will be readily appreciated by those skilled in the art that the packer deactivation device could be integrally incorporated into the packer, or into the safety joint. As another alternative, the packer 20, safety joint 30 and packer deactivation device 102 could be integrally incorporated into a single item of equipment capable of being interconnected in the tubular string 12. Thus, the scope of this disclosure is not limited to any particular configuration or combination of components.

In the FIG. 4 example, the plug 78, chambers 82, 82 and piston 84 comprise a drag block locking mechanism 104 which prevents displacement of the drag block 42 in an upward direction relative to the packer mandrel 34. In the FIG. 5 example, the drag block locking mechanism 104 comprises the slips 88, ramp 90 and biasing device 92. In the FIG. 6 example, the locking mechanism 104 comprises the collets 98 and recess 100. This demonstrates that a variety of different locking mechanisms 104 can be used in the system 32 and, therefore, the scope of this disclosure is not limited at all to use of any particular locking mechanism.

It may now be fully appreciated that the above disclosure provides significant advancements to the arts of constructing and operating packers and safety joints. Activation of the safety joint 30 in the depicted system 32 examples deactivates the packer 20, so that the packer and tubular string upper section 12*a* can be retrieved without setting the packer. A drag block 42 on the packer 20 is secured against displacement in at least one direction relative to the packer mandrel 34, in response to activation of the safety joint 30.

A packer deactivation system 32 is described above. In one example, the system 32 can include a packer 20 and a safety joint 30. Activation of the safety joint 30 can prevent setting of the packer 20.

Activation of the safety joint 30 can disconnect sections 12*a,b* of a tubular string 12.

Activation of the safety joint 30 can prevent displacement of a drag block 42 of the packer 20 in at least one direction relative to a mandrel 34 of the packer 20.

Activation of the safety joint 30 can expose a chamber 80 to pressure in a wellbore 14.

Activation of the safety joint 30 can engage a drag block locking mechanism 104.

Activation of the safety joint 30 can engage a collet 98, thereby preventing setting of the packer 20.

Activation of the safety joint 30 can engage a gripping device 88, thereby preventing displacement of a drag block 42 of the packer 20 in at least one direction relative to a mandrel 34 of the packer 20.

A method for use with a subterranean well is also described above. In one example, the method can include: activating a safety joint 30 in the well; and deactivating a packer 20 connected to the safety joint 30, in response to the safety joint 30 activating.

Activating the safety joint 30 can comprise applying a predetermined tensile load to the safety joint 30, thereby displacing a mandrel 46 of the safety joint 30 in a direction relative to an outer housing 54 of the safety joint 30. Deactivating the packer 20 can comprise preventing a drag block 42 of the packer 20 from displacing in the direction relative to a mandrel 34 of the packer 20. Preventing the drag block 42 from displacing in the direction may be performed in response to displacing the safety joint mandrel 46 in the direction.

The method can include setting the packer 20 prior to activating the safety joint 30.

Another packer deactivation system 32 described above can include a safety joint 30 and a packer drag block locking mechanism 104. Activation of the safety joint 30 can operate the drag block locking mechanism 104, thereby preventing a drag block 42 from displacing in a direction relative to a mandrel 34 of a packer 20.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A packer deactivation system for use in a well, comprising:

a packer activatable in the well;

a safety joint activatable to disconnect a first section of a tubular string from a second section of the tubular string, wherein activation of the safety joint deactivates the packer;

a packer deactivation device activatable by the activation of the safety joint to prevent the activation and setting of the packer;

a drag block locking mechanism disposed between the packer and the safety joint;

a telescoping joint coupled to the drag block locking mechanism;

wherein:

activation of the safety joint engages a collet in the drag block locking mechanism via the telescoping joint to prevent setting of the packer;

the packer deactivation device is interconnected between the packer and the safety joint; and the packer comprises a drag block and slips coupled to a packer mandrel.

2. The system of claim 1, wherein activation of the safety joint allows the first and second sections of the tubular string to be disconnected, allowing for removal of the packer and the first section of the tubular string from the well while leaving the second section of the tubular string in the well.

3. The system of claim 1, wherein activation of the safety joint prevents displacement of the drag block of the packer in at least one direction relative to the packer mandrel.

4. A method for use in a well, comprising:

activating a safety joint connected to a packer in the well, wherein activating the safety joint comprises shearing shear pins disposed between a safety joint mandrel and an outer housing of the safety joint;

deactivating the packer by activating the safety joint;

preventing the activation and setting of the packer by activating the safety joint;

operating a drag block locking mechanism by activating the safety joint;

disconnecting the packer and a first section of a tubular string from a second section of the tubular string; and removing the packer and the first section of the tubular string from the well while leaving the second section of the tubular string in the well.

5. The method of claim 4, wherein activating the safety joint further comprises applying a predetermined tensile load to the safety joint, thereby displacing the safety joint mandrel of the safety joint in a direction relative to the outer housing of the safety joint.

6. The method of claim 5, wherein deactivating the packer further comprises preventing a drag block of the packer from displacing in the direction relative to a mandrel of the packer.

7. The method of claim 6, wherein preventing the drag block from displacing in the direction is performed in response to displacing the safety joint mandrel in the direction.

8. The method of claim 4, wherein activating the safety joint further comprises engaging the drag block locking mechanism to prevent a drag block of the packer from displacing in the direction relative to a mandrel of the packer.

9. The method of claim 4, wherein activating the safety joint further comprises engaging a collet, thereby preventing setting of the packer.

10. The method of claim 4, wherein activating the safety joint further comprises engaging a gripping device, thereby preventing displacement of a drag block of the packer in at least one direction relative to a mandrel of the packer.

* * * * *